United States Patent [19]

Sturgeon

[11] 4,300,609

[45] Nov. 17, 1981

[54] INTERCHANGABLE AND REUSABLE HANDBAG KIT

[76] Inventor: Aurora A. Sturgeon, 3903 Fairway Dr., Cameron Park, Calif. 95682

[21] Appl. No.: 144,403

[22] Filed: Apr. 28, 1980

[51] Int. Cl.[3] ..... A45C 13/06

[52] U.S. Cl. ..... 150/29

[58] Field of Search ..... 150/29, 46, 16

[56] References Cited

U.S. PATENT DOCUMENTS 2,435,870 2/1948 Campos ..... 150/29

FOREIGN PATENT DOCUMENTS 470203 6/1914 France ..... 150/29

*Primary Examiner*—Donald F. Norton

*Attorney, Agent, or Firm*—Melvin R. Stidham

[57] ABSTRACT

An interchangable and reusable handbag kit comprising a pair of generally U-shaped frame members with somewhat flexible insert retainer members of complementary size and shape. A pouch of fabric or the like may be stitched or otherwise secured to the retainer members which are inserted from the open end of the U-shaped frames into slots extending around the inside thereof, flexing them past a pair of stop members. Fully inserted, the stop members prevent inadvertent removal.

3 Claims, 2 Drawing Figures

INTERCHANGABLE AND REUSABLE HANDBAG KIT

BACKGROUND OF THE INVENTION

Generally, when a person wishes to have an assortment of handbags to match various ensembles or accessories, it is necessary to maintain a selection of bags of various colors, materials, and patterns. Moreover, it is impractical to try to match the fabric of a dress or ensemble, because when the article of apparel is discarded the handbag or puuse may be deemed obsolete.

OBJECTS OF THE INVENTION

It is an object of this invention to provide a handbag kit which enables one to readily substitute any one of several needlework, fabric or leather pouches into a single frame.

It is further object of this invention to provide a handbag kit which enables a wide selection of colors, fabrics, handicrafted patterns, leathers and the like to present a unique style, without requiring the expenditure of an excessive amount of money.

It is a further object of this invention to enable one feasibly to amass a wide selection of handbags without requiring a great deal of storage space for those not in use at any given time.

Other objects and advantages of this invention will become apparent from the description to follow, particularly when read in conjunction with the accompanying drawing.

SUMMARY OF THE INVENTION

In carrying out this invention, I provide a pair of U-shaped frame members, which are hinged together at the open ends of the "U"s. Plastic retainer insert members of complementary size and shape, includes means by which they may be secured to the edges of pouches of selected colors, materials and patterns. The retainer members are inserted into slots or recesses around the frame members, and when fully in place, are locked by stop members against inadvertent removal. Hence, each pouch of a wide selection thereof, is secured to a pair of flexible retainer members, and the legs of the retainer members may be flexed toward each other, withdrawn from the frames past the stop members, and quickly replaced, by inserting another selected pouch, with insert retainers attached, into the same purse frame.

DESCRIPTION OF A PREFERRED EMBODIMENT

Figure 1:
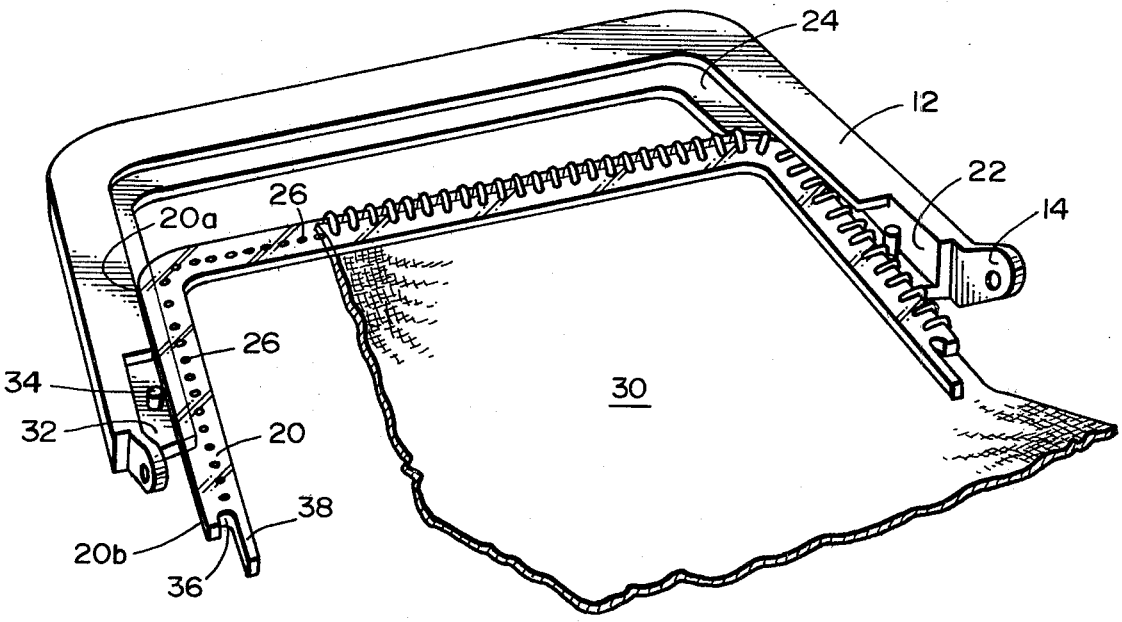
FIG. 1 is a view in perspective of a purse frame member and retainer member with purse pouch secured thereto.

Referring now to the drawing with greater particularity the purse kit 10 of this invention comprises a pair of generally U-shaped, fairly rigid frame members 12, being made of wood, metal, suitable plastics or the like and hinged together at 14, as by means of a suitable hinge pin 16.

Generally U-shaped, complementary insert retainer members 20, which may be of relatively thin plastic or the like, are generally of a size and shape to fit fairly snugly within the bottom wall 22 of a recess or groove 24 which extends around each of the U-shaped frame members 12, as will be further described.

Extending around each complementary insert retainer member 20 is a row of securing members 26 for attaching them to the edges 28 of a pre-formed pouch 30 of fabric, leather or the like. For example, the securing means may take the form of a row of holes 26 through which the pouch edges 28 may be stitched, or in the case of a needlecraft pouch, worked onto the insert 20 to secure it firmly to the insert retainer member 20.

Carried on one side wall 32 of the frame member slots 24 at the ends of the legs of the frame member 12 are small stop members 34, which may take the form of pins or pegs 34. Complementary sockets or recesses 36 are formed in the ends of the retainer members 20, leaving an internal extension 38, for a purpose to be described.

The retainer members 20 are made somewhat flexible, with memory, to facilitate insertion into the slots 24 of the frame members 12. In addition, the retainer members 20 may be made slightly narrower at their closed ends **20*a* than at their open ends 20*b*. Hence, the narrower closed ends are inserted from the open end 14 of the frame members 12, between the stop pins 34 and into the slot 24. As a retainer member is inserted further, the stop members 34 cam or flex the legs of the retainer members 20 inward to enable insertion. Once the open ends 20*b* are past the stop member, the flexural strength of the retainer members 20 spread the legs apart again into engagement with, or adjacent to, the bottom wall 22 of the slot 24. In this position, the socket 36 can be seated over the stop pins 34 to prevent inadvertently removal of there placement bag 30**.

It will be readily understood that a wide selection of pouches of different materials, fabrics, patterns or the like may be preformed and each stitched or otherwise secured to a pair of retainer members 20. Then, in order to change a handbag, one need merely grasp the leg extension 38 of the retainer members 20, force them up further into the recesses 24, and then flex them inward to remove the pouch 30 between the stop members 24. Then, the retainer members of a substitute pouch may be inserted between the pins 34, as previously described. When both retainer members are in place, the replacement in complete. Thus, a wide selection of bags can be provided with a single frame 10 of a neutral color or just a minimum number of frames 10 of selected basic colors.

Figure 2:
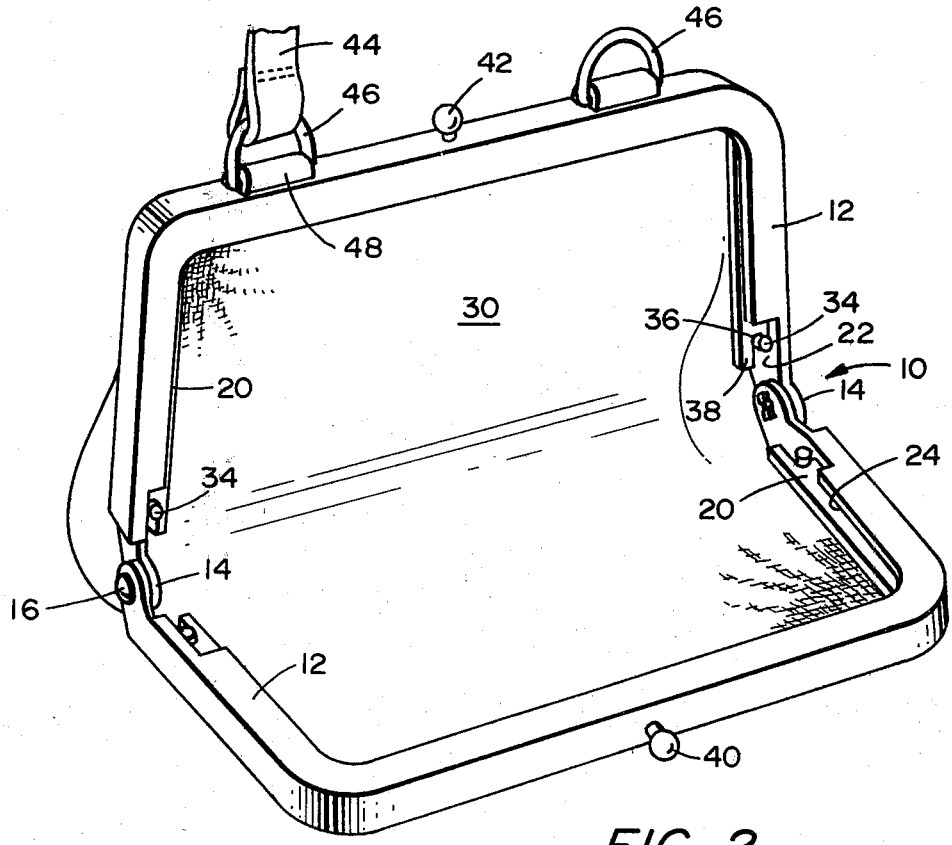
FIG. 2 is a view in perspective of the complete purse assembly.

As shown in FIG. 2, the frame 10 may be provided with suitable complementary clasp elements 40 and 42, and with a carrying strap 44, which may be secured to a frame member 12 as by means of D-rings 46 carried in receptacles 48.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is :

1. A handbag kit comprising:

a pair of generally U-shaped frame members hinged together at the ends of the legs of said frame members;

a recess around the inside surface of each of said frame members;

a generally U-shaped retainer member having a bight and two diverging legs slidably received in each of said recesses from the open end of one of said U-shaped frame members;

means for securing the edges of a pouch around said retainer members, and interengagable stop means on the frame members and retainer members, and the retainer members having sufficient resilience to permit flexing of the diverging legs toward each other when being inserted in said recesses and then outward springing of the legs to result in engagement of the interengageable stop means.

2. The kit defined by claim 1 wherein:

said stop means are in the form of small pegs on a side wall of said recesses; and including;

complementary sockets in the ends of said retainer members adapted when fully received in said recesses, to seat over said stop pegs.

3. The kit defined by claim 1 wherein said securing means comprises:

a row of holes around each of said retainer members adapted to receive stitches.

* * * * *